United States Patent [19]

Klaren

[11] 4,410,029

[45] Oct. 18, 1983

[54] METHOD OF OPERATING HEAT EXCHANGER APPARATUS COMPRISING A PLURALITY OF HEAT EXCHANGER UNITS CONNECTED IN SERIES, AND APPARATUS ADAPTED FOR OPERATION BY THE METHOD

[75] Inventor: Dick G. Klaren, Ijmuiden, Netherlands

[73] Assignee: Esmil BV, Amsterdam, Netherlands

[21] Appl. No.: 294,024

[22] Filed: Aug. 18, 1981

[30] Foreign Application Priority Data

Sep. 5, 1980 [NL] Netherlands ..... 8005023

[51] Int. Cl.[3] ..... F28D 13/00; F28G 13/00

[52] U.S. Cl. ..... 165/1; 165/95; 165/103; 165/104.16

[58] Field of Search ..... 165/95, 104.16, 103, 165/1

[56] References Cited

U.S. PATENT DOCUMENTS 2,817,498 12/1957 Miller ..... 165/103
3,586,487 6/1971 Juhasz ..... 165/95 X
4,119,139 10/1978 Klaren ..... 165/104.16 X

*Primary Examiner*—Albert W. Davis, Jr.
*Attorney, Agent, or Firm*—Stevens, Davis, Miller & Mosher

[57] ABSTRACT

A method is described of operating heat-exchanger apparatus comprising a plurality of heat exchanger units which are connected together in series for countercurrent flow of respectively a first heat exchanging medium which contains fluidizable particulate material and a second heat-exchanging medium. Each said unit comprises at least one vertical tubular duct in which said first heat-exchanging medium flows upwardly with said particulate material in a fluidized state and a compartment through which said second heat exchanging medium passes and through which said duct extends. The particulate material acting to remove deposits formed on the tube inside walls by the first medium. In order to achieve cleaning of the tubes in cases where a high rate of deposit occurs, flow of said second medium through each of the compartments is intermittently interrupted for a period of time, while flow through at least one other of said compartments is maintained. Thus the cleaning effect of the particles is increased in the tubes of the compartment for this period of time.

6 Claims, 1 Drawing Figure

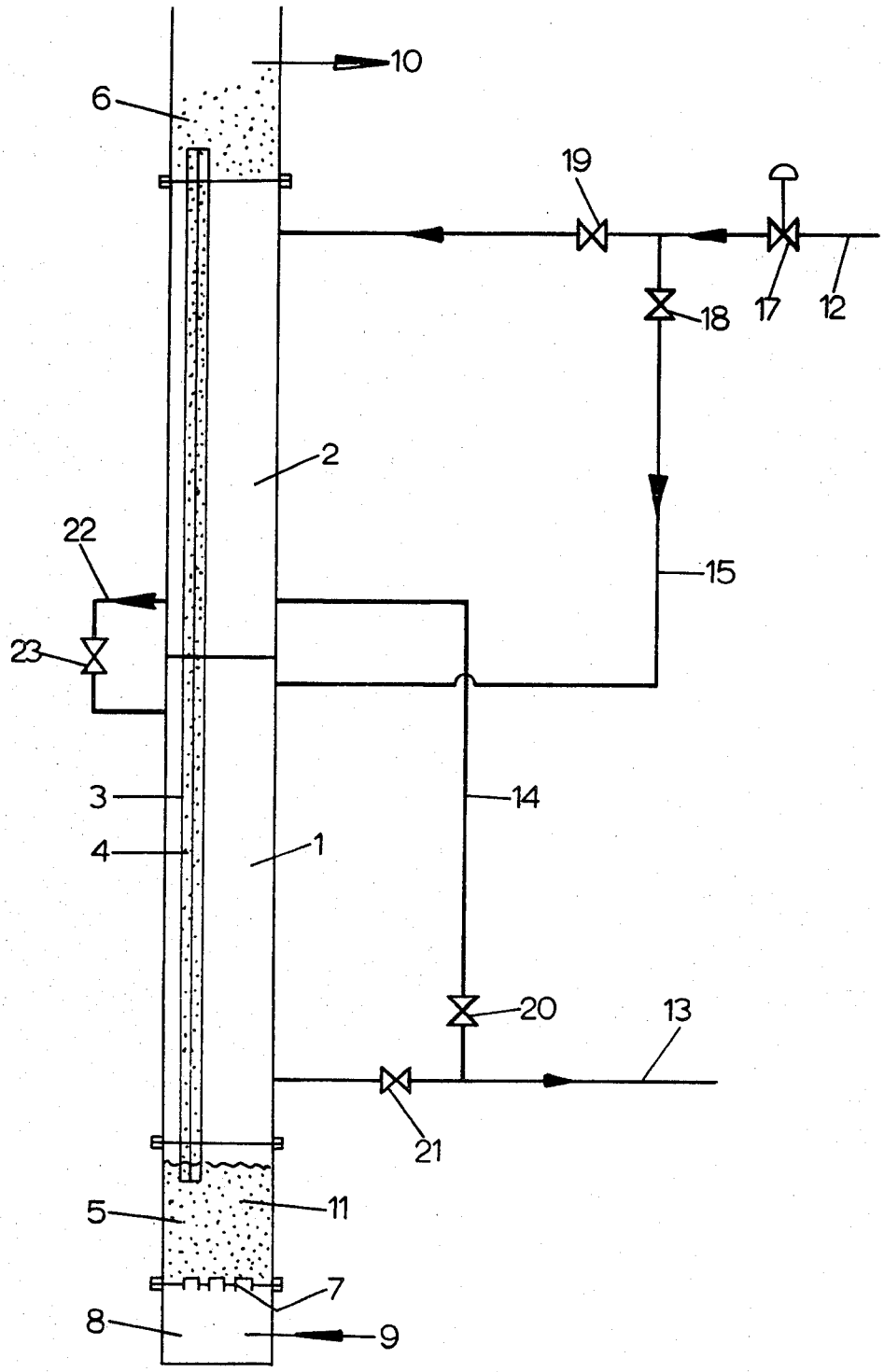
10
6
19
17
12
18
2
22
15
23
3
14
4
1
20
13
21
5
11
7
8
9

METHOD OF OPERATING HEAT EXCHANGER APPARATUS COMPRISING A PLURALITY OF HEAT EXCHANGER UNITS CONNECTED IN SERIES, AND APPARATUS ADAPTED FOR OPERATION BY THE METHOD

BACKGROUND OF THE INVENTION

1. Field of the Invention

The invention relates to a method of operating a heat exchanger apparatus comprising at least two heat exchanger units arranged in series, each unit having at least one vertical tubular duct for a first heat exchanging medium containing fluidizable granular material and a compartment for a second heat-exchanging medium through which said duct extends.

2. Description of the Prior Art

A heat exchanger apparatus of the type described above is disclosed in for example published Dutch patent application No. 77 03939 (GB No. 1,592,232). A problem arises in the use of such an apparatus when the first heat exchanging medium is a liquid which, as a result of the temperature change occurring in the heat-exchange process, creates heavy dirtying of the ducts through which it passes.

This is the case, for example, with liquids containing albumen, the albumen coagulating as the temperature rises. It is alternatively possible for a liquid to have a component which crystallizes out as the temperature is lowered.

A heat exchanger where a fluidised granular material is present in the vertical tubular ducts is in itself particularly suitable to withstand such dirtying. The intensive movement in the fluidized granules exercises a light scouring effect on the duct wall, so that substances sticking to it are removed. In practice, it has in fact been found that the fluidized material can certainly remove all kinds of deposits from the heat-exchanging surface and is therefore suitable for applications where heavy pollution may arise. This means that the heat exchanger does not have to be cleaned very frequently with chemicals or that the heat-exchanging elements do not have to be frequently dismantled so that they can then be cleaned mechanically and/or chemically.

Nonetheless, it has been found that applications exist for the exchange of heat between two media where the first heat-exchanging medium causes such intensive dirtying of the installation that even with the fluidized granular bed continuously in use excessive deposits occur in the vertical ducts.

SUMMARY OF THE INVENTION

The object of the invention is to provide a method by which in the apparatus described, excessive dirtying is avoided without the heat-exchanging elements having to be dismantled and without chemical cleaning of the heat-exchanging elements being necessary.

The invention, simply stated, consists in that the flow of the second heat-exchanging medium is cut off through each compartment intermittently during operation while the flow of this medium is maintained through at least one other compartment. The period of cessation of the flow of second medium is chosen to give sufficient time for the duct or ducts running through the compartment to be cleaned again sufficiently by the action of the particulate material. Thus the cleaning effect is enhanced during this period.

The invention is based on the assumption that the first medium has substantially no dirtying effect if its temperature does not change in a compartment. The fluidised mass of granules in the vertical ducts will in fact continue to have a scouring and cleaning effect on the duct walls. Deposits present will thereby be removed again by the granular mass. Once the duct walls in a compartment have been cleaned, the second medium heating or cooling the flow of first medium can be admitted to the compartment again and the flow of second medium can then be cut off from another compartment.

The control of flow of second medium through the compartments may be controlled in the desired manner by means of valves.

It may be no simple matter to decide during operation which compartment of the heat exchanger is heavily dirtied. It is therefore recommended, in accordance with the invention for the compartments to be grouped together so that groups of compartments can be cut off. It is then a simple matter for the groups of compartments to be connected to or uncoupled from the flow of the second medium according to a fixed plan. After some experimentation, such a plan can be so devised that the degree of dirtying in each of the compartments will never exceed a set value. It should be mentioned in this connection that the cleaning of a compartment generally proceeds faster than its dirtying, so that in practice it is not difficult to work out a suitable switching chart for effective operation.

Although the invention is applicable to an apparatus with a large number of compartments arranged in series, it has been found in practice that in most cases good results con be achieved even when only two heat exchangers are coupled in series.

For the sake of simplicity of construction in the apparatus it is further recommended that the heat exchangers be built together with the tubular ducts extending continuously through compartments which are directly adjacent to each other.

BRIEF DESCRIPTION OF THE DRAWING

The preferred embodiment of the invention will now be described by way of example only and with reference to the accompanying drawing in which the single FIGURE is a diagrammatic view of a heat-exchanger apparatus adapted for operation in the method of the invention.

DESCRIPTION OF THE PREFERRED EMBODIMENT

The illustrated apparatus comprises two heat exchanger units having respective compartments 1 and 2 which are arranged one vertically directly above the other. Parallel tubes 3 pass continuously through both compartments 1 and 2 and during operation are filled with a fluidized granular material 4. The bottom ends of the tubes 3 extend into a lower box 5 and their upper ends into an upper box 6. The lower box 5 is coupled by a distributor plate 7 to a distribution box 8, into which a supply 9 for a primary heat-exchanging medium debouches. The primary medium passes from the distribution box 8 through the lower box 5 beneath, the tubes 3 and the upper box 6 before leaving the aparatus via an outlet 10.

A secondary heat exchanging medium is supplied via a pipe 12 and a main valve 17 and removed via a pipe 13. The supply pipe 12 is connected by a further valve 19 to the top end of the upper compartment 2 while the discharge pipe 13 is connected via a valve 13 to the bottom end of the lower compartment 1. A series connection 22 with a valve 23 connects the two compartments 1,2.

Each of the two heat-exchanger units thus consists of a compartment 1,2 providing a space for the secondary medium and the portions in the compartment of the tubes 3 which provide the duct for the primary medium. In normal operation, the units are connected in series for countercurrent flow of the two media by opening valves 17,19,23 and 21.

The system further includes by-pass pipes 14 and 15 with respective valves 18,20 as indicated in the FIGURE. If the valves 18 and 20 are closed and valves 19,21 and 23 are open as already described, the secondary medium flows through both compartments 2 and 1, so that the primary medium is heated up or cooled down, as the case may be. By opening valve 18 and closing valves 19 and 23, the secondary medium is caused to flow only through the compartment 1, so that no heat is exchanged in compartment 2 and no temperature gradient is therefore present in the wall of the pipes 3 in that compartment. Conversely, when valves 18,21 and 23 are closed and valves 19 and 20 are open, the secondary medium will flow only through compartment 2, so that heat is exchanged there only and no temperature gradient is present in the wall of the pipes 3 in the compartment 1.

If valves 18 and 20 are initially both closed during operation so that the secondary medium can flow through the two compartments 1 and 2 through the open valves 19,21 and 23, the walls of the pipes 3 may become excessively dirtied if the primary medium is of a type which has highly polluting properties on cooling (or, as the case may be, on heating). After some time, the dirt will be noticeable because of a change in a process parameter such as e.g. pressure, mass flow, temperature, etc. If the dirt has then reached a maximum permissible value, valves 19 and 23 can first be closed and valve 18 opened. No heat will then be exchanged in compartment 2 and no temperature gradient is present across the wall of the pipes 3 in that compartment. The primary liquid will then no longer dirty the pipe walls on flowing through the compartment 2, so that these pipe walls in compartment 2 will be cleaned by the scouring effect of the fluidized granular mass within the pipes 3 in that compartment. After a suitable period of time, valves 18 and 21 can then be closed and valves 19 and 20 opened. This results in the walls of pipes 3 in compartment 1 being cleaned in a similar way.

Depending on the design of the installation, the nature of the primary liquid, and the operating mode, suitable plans can be worked out empirically for the switching of the various valves. This will present the expert with no problems since it has been found that the cleaning effect of the scouring by the granular mass over the pipe wall in the absence of a temperature gradient over the pipe wall will usually proceed more rapidly than the dirtying of the pipe wall in the presence of a temperature gradient.

Although only two exchanger units are shown in the FIGURE, it will be clear that the same principle can also be applied to a larger number of compartments arranged in series. Even if several compartments are arranged as separate heat exchangers, each with a lower and upper box or combined with lower and upper boxes, the principle of cleaning the pipe walls by suitably switching the secondary medium can be applied. The major advantage of the method of operation of the invention is that the switched operation described allows the apparatus to be operated continuously without the heat-exchanging elements needing to be dismantled and without chemical cleaning being necessary.

What is claimed is:

1. Method of operating heat-exchanger apparatus comprising a plurality of heat exchanger units which are connected together in series for countercurrent flow of respectively a first heat exchanging medium which contains fluidisable particulate material and a second heat-exchanging medium, each said unit comprising at least one vertical tubular duct in which said first heat-exchanging medium flows upwardly with said particulate material in a fluidized state and a compartment through which said second heat-exchanging medium passes and through which said duct extends, the particulate material acting to remove deposits formed on the tube inside walls by the first medium, said method including the step of intermittently interrupting the flow of said second medium through each of the compartments for a period of time, while flow through at least one other of said compartments is maintained, in order that the cleaning effect of the removal of the said deposits by the particulate material is temporarily increased in that compartment.

2. Method according to claim 1 wherein the flow of the second medium through a plurality of compartments is interrupted simultaneously, while its flow through other compartments continues.

3. Method according to claim 1 wherein the apparatus comprises two said units coupled in series.

4. Method according to any one of claims 1, 2 and 3 wherein the said units are arranged one above another, said tubular ducts being formed by one or more tubes extending continuously through the compartments.

5. Heat-exchanger apparatus adapted for operation by the method of claim 1, having a plurality of heat-exchanger units arranged in series, each unit comprising a vertical duct for the first medium and a compartment for the second medium, there being supply and discharge conduits for each compartment, wherein said supply and discharge conduits include valves permitting interruption of the flow of the second medium through each of said compartments while flow continues through at least one other of said compartments.

6. Method of operating heat-exchanger apparatus comprising the steps of:

passing a first heat-exchanging medium upwardly through a plurality of vertical heat exchanging tubular ducts arranged in series, said first medium containing a fluidizable particulate medium which is maintained in fluidized condition by the flow of the first medium and the particulate material abrasively removing deposits formed on said tubes by deposition from said first medium, passing a second heat exchanging medium through a plurality of heat-exchanger compartments arranged in series through which said tubular ducts respectively pass, so that heat-exchange takes place across the tubular duct walls, the series flow of the first medium being countercurrent to that of the second medium, intermittently cutting off flow of the second medium through each of said compartments while maintaining flow of the first medium through the said tubular duct of that compartment and maintaining flow of the second medium through at least one other of said compartments, whereby the cleaning effect of the removal of deposits by the particulate material in the said duct of that compartment is enhanced during the said period of time.

* * * * *